US010902802B2

(12) United States Patent
He

(10) Patent No.: US 10,902,802 B2
(45) Date of Patent: Jan. 26, 2021

(54) DRIVING METHOD OF DISPLAY PANEL AND DISPLAY APPARATUS

(71) Applicant: HKC Corporation Limited, Shenzhen (CN)

(72) Inventor: Huai Liang He, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/340,607

(22) PCT Filed: Aug. 15, 2018

(86) PCT No.: PCT/CN2018/100595

§ 371 (c)(1),
(2) Date: Apr. 9, 2019

(87) PCT Pub. No.: WO2019/047689

PCT Pub. Date: Mar. 14, 2019

(65) Prior Publication Data

US 2019/0237030 A1 Aug. 1, 2019

(30) Foreign Application Priority Data

Sep. 11, 2017 (CN) ..... 2017 1 0814370

(51) Int. Cl.
*G09G 3/36* (2006.01)

(52) U.S. Cl.
CPC ..... *G09G 3/3611* (2013.01); *G09G 3/36* (2013.01); *G09G 3/3607* (2013.01)

(58) Field of Classification Search
CPC ..... G09G 3/3611; G09G 3/36; G09G 3/3607
See application file for complete search history.

(56) References Cited

U.S. PATENT DOCUMENTS

2003/0169247 A1* 9/2003 Kawabe ..... G09G 3/3648 345/204
2015/0172529 A1* 6/2015 Aota ..... H04N 5/378 348/228.1
2018/0114478 A1* 4/2018 Tien ..... G09G 5/02

* cited by examiner

*Primary Examiner* — Sahlu Okebato
(74) *Attorney, Agent, or Firm* — WPAT, PC

(57) ABSTRACT

A driving method of a display panel and a display apparatus are provided. The method includes: dividing pixels into multiple pixel groups, each pixel group including adjacent first and second pixel units, and each pixel unit includes sequentially arranged first through third sub-pixels; displaying each picture by sequential multiple frames of images; obtaining first and second voltage signals of each pixel group in each frame of image; and adjusting the first and second voltage signals to make average signals of all first voltage signals of respective frames of images be the same, average signals of all second voltage signals of respective frames of images be the same, average signals of first voltage signals in the frames of images of different pixel groups respectively be the same, and average signals of second voltage signals in the frames of images of different pixel groups respectively be the same.

20 Claims, 6 Drawing Sheets

| First frame | | Second frame | | Third frame | | Fourth frame | |
|---|---|---|---|---|---|---|---|
| A1-128 | A2-56 | A1-124 | A2-60 | A1-124 | A2-56 | A1-124 | A2-56 |
| A3-56 | A4-124 | A3-56 | A4-124 | A3-56 | A4-128 | A3-60 | A4-124 |
| A5-124 | A6-60 | A5-128 | A6-56 | A5-124 | A6-56 | A5-124 | A6-56 |
| A7-56 | A8-124 | A7-56 | A8-124 | A7-60 | A8-124 | A7-56 | A8-128 |

| First frame | | Second frame | | Third frame | | Fourth frame | |
|---|---|---|---|---|---|---|---|
| G1-56 | G2-128 | G1-60 | G2-124 | G1-56 | G2-124 | G1-56 | G2-124 |
| G3-124 | G4-56 | G3-124 | G4-56 | G3-128 | G4-56 | G3-124 | G4-60 |
| G5-60 | G6-124 | G5-56 | G6-128 | G5-56 | G6-124 | G5-56 | G6-124 |
| G7-124 | G8-56 | G7-124 | G8-56 | G7-124 | G8-60 | G7-128 | G8-56 |

| First frame | | Second frame | | Third frame | | Fourth frame | |
|---|---|---|---|---|---|---|---|
| A1-128 | A2-56 | A1-124 | A2-60 | A1-124 | A2-56 | A1-124 | A2-56 |
| A3-56 | A4-124 | A3-56 | A4-124 | A3-56 | A4-128 | A3-60 | A4-124 |
| A5-124 | A6-60 | A5-128 | A6-56 | A5-124 | A6-56 | A5-124 | A6-56 |
| A7-56 | A8-124 | A7-56 | A8-124 | A7-60 | A8-124 | A7-56 | A8-128 |

| First frame | | Second frame | | Third frame | | Fourth frame | |
|---|---|---|---|---|---|---|---|
| G1-56 | G2-128 | G1-60 | G2-124 | G1-56 | G2-124 | G1-56 | G2-124 |
| G3-124 | G4-56 | G3-124 | G4-56 | G3-128 | G4-56 | G3-124 | G4-60 |
| G5-60 | G6-124 | G5-56 | G6-128 | G5-56 | G6-124 | G5-56 | G6-124 |
| G7-124 | G8-56 | G7-124 | G8-56 | G7-124 | G8-60 | G7-128 | G8-56 |

| First frame | | Second frame | | Third frame | | Fourth frame | |
|---|---|---|---|---|---|---|---|
| A1-128 | A2-56 | A1-124 | A2-60 | A1-128 | A2-56 | A1-124 | A2-60 |
| A3-60 | A4-124 | A3-56 | A4-128 | A3-60 | A4-124 | A3-56 | A4-128 |
| A5-124 | A6-60 | A5-128 | A6-56 | A5-124 | A6-60 | A5-128 | A6-56 |
| A7-56 | A8-128 | A7-60 | A8-124 | A7-56 | A8-128 | A7-60 | A8-124 |

FIG. 7

| First frame | | Second frame | | Third frame | | Fourth frame | |
|---|---|---|---|---|---|---|---|
| A1-128 | A2-56 | A1-128 | A2-60 | A1-128 | A2-60 | A1-124 | A2-60 |
| A3-60 | A4-124 | A3-60 | A4-128 | A3-60 | A4-128 | A3-56 | A4-128 |
| A5-128 | A6-60 | A5-128 | A6-56 | A5-124 | A6-60 | A5-128 | A6-60 |
| A7-60 | A8-128 | A7-60 | A8-124 | A7-56 | A8-128 | A7-60 | A8-128 |

FIG. 8

| First frame | | Second frame | | Third frame | | Fourth frame | |
|---|---|---|---|---|---|---|---|
| A1-124 | A2-56 | A1-124 | A2-56 | A1-124 | A2-56 | A1-124 | A2-56 |
| A3-56 | A4-124 | A3-56 | A4-124 | A3-56 | A4-124 | A3-56 | A4-124 |
| A5-124 | A6-56 | A5-124 | A6-56 | A5-124 | A6-56 | A5-124 | A6-56 |
| A7-56 | A8-124 | A7-56 | A8-124 | A7-56 | A8-124 | A7-56 | A8-124 |

FIG. 9

| First frame | | Second frame | | Third frame | | Fourth frame | |
|---|---|---|---|---|---|---|---|
| A1-128 | A2-60 | A1-128 | A2-60 | A1-128 | A2-60 | A1-128 | A2-60 |
| A3-60 | A4-128 | A3-60 | A4-128 | A3-60 | A4-128 | A3-60 | A4-128 |
| A5-128 | A6-60 | A5-128 | A6-60 | A5-128 | A6-60 | A5-128 | A6-60 |
| A7-60 | A8-128 | A7-60 | A8-128 | A7-60 | A8-128 | A7-60 | A8-128 |

DRIVING METHOD OF DISPLAY PANEL AND DISPLAY APPARATUS

FIELD OF THE DISCLOSURE

The disclosure relates to the field of display technology, and more particularly to a driving method of a display panel and a display apparatus.

BACKGROUND

An exemplary liquid crystal display technology uses a 6-bit driver IC to realize an 8-bit picture quality resolution rendering, and further uses a FRC (Frame Rate Control) technology to divide two adjacent grayscales into more than two grayscales and display a target display grayscale by multiple frames. The multiple frames are distributed in quantity for display, so as to achieve the showing of equivalent brightness perceived by human eyes based on persistence of vision.

However, when displaying a 125th-level luminance signal and a 57th-level luminance signal, because the 6-bit driver IC only can realize 8-bit resolution displays of the 124th-level luminance signal as well as the 128th-level luminance signal and 8-bit resolution displays of the 56th-level luminance signal as well as the 60th-level luminance signal, and therefore it needs multiple frames to distribute for display. If average brightnesses based on the distribution are different, equivalent brightnesses perceived by human eyes would have bright and dark changes, and the naked eyes will feel the noticeable flicker phenomenon of unequal brightness.

SUMMARY

Therefore, there is a need to provide a driving method of a display panel and a display apparatus, so as to address the problem of low frequency brightness flicker.

In an aspect, a driving method of a display panel includes: dividing pixels into a plurality of pixel groups, wherein each of the pixel groups includes a first pixel unit and a second pixel unit adjacent to each other, each of the first and second pixel units includes a first sub-pixel, a second sub-pixel and a third sub-pixels sequentially arranged in an order; displaying each picture by using sequential multiple frames of images; obtaining a first voltage signal and a second voltage signal of each of the pixel groups in each of the frames of images, wherein the first voltage signal drives the first sub-pixel and the third sub-pixel of the first pixel unit and the second sub-pixel of the second pixel unit, the second voltage signal drives the first sub-pixel and the third sub-pixel of the second pixel unit and the second sub-pixel of the first pixel unit, and the first voltage signal is not equal to the second voltage signal; and adjusting the first voltage signal and the second voltage signal to make average signals of all the first voltage signals of the respective frames of images be the same, average signals of all the second voltage signals of the respective frames of images be the same, average signals of the first voltage signals in the multiple frames of images of different ones of the pixel groups respectively be the same, and average signals of the second voltage signals in the multiple frames of images of different ones of the pixel groups respectively be the same. The first pixel unit and the second pixel unit are adjacently disposed in a same row. In the same row, for adjacent two of the pixel groups, the first pixel unit of one pixel group is disposed adjacent to the second pixel unit of the other one pixel group. The first voltage signal is higher than the second voltage signal.

In another aspect, a driving method of a display panel includes: dividing pixels into a plurality of pixel groups, wherein each of the pixel groups comprises a first pixel unit and a second pixel unit adjacent to each other, each of the first and second pixel units comprises a first sub-pixel, a second sub-pixel and a third sub-pixels sequentially arranged in an order; displaying each picture by using sequential multiple frames of images; obtaining a first voltage signal and a second voltage signal of each of the pixel groups in each of the frames of images, wherein the first voltage signal drives the first sub-pixel and the third sub-pixel of the first pixel unit and the second sub-pixel of the second pixel unit, the second voltage signal drives the first sub-pixel and the third sub-pixel of the second pixel unit and the second sub-pixel of the first pixel unit, and the first voltage signal is not equal to the second voltage signal; and adjusting the first voltage signal and the second voltage signal to make average signals of all the first voltage signals of the respective frames of images be the same, average signals of all the second voltage signals of the respective frames of images be the same, average signals of the first voltage signals in the multiple frames of images of different pixel groups respectively be the same, and average signals of the second voltage signals in the multiple frames of images of different pixel groups respectively be the same.

In an embodiment, the first pixel unit and the second pixel unit are adjacently disposed in a same row.

In an embodiment, in the same row, in the same row, for adjacent two of the pixel groups, the first pixel unit of one pixel group is disposed adjacent to the second pixel unit of the other one pixel group.

In an embodiment, the first pixel unit and the second pixel unit are adjacently disposed in a same column.

In an embodiment, in the same column, in the same row, for adjacent two of the pixel groups, the first pixel unit of one pixel group is disposed adjacent to the second pixel unit of the other one pixel group.

In an embodiment, the multiple frames of images are four frames of images.

In an embodiment, the four frames of images sequentially are a first frame of image, a second frame of image, a third frame of image and a fourth frame of image.

In an embodiment, the first voltage signal is higher than the second voltage signal.

In an embodiment, each of the first and second pixel units includes three color sub-pixels.

In an embodiment, the three color sub-pixels respectively are a red sub-pixel, a green sub-pixel and a blue sub-pixel.

In an embodiment, the first sub-pixel, the second sub-pixel and the third sub-pixel respectively are a red sub-pixel, a green sub-pixel and a blue sub-pixel.

In an embodiment, driving voltage polarities for adjacent sub-pixels are opposite.

In an embodiment, the first voltage signal and the second voltage signal respectively are corresponding to different signal values.

In an embodiment, the signal values corresponding to the first voltage signal are 124 and 128, and the signal values corresponding to the second voltage signal are 56 and 60.

In an embodiment, the sub-pixels driven by the first voltage signal and the second voltage signal have different signal values.

In an embodiment, the first voltage signal and the second voltage signal alternately drive the sub-pixels.

In still another aspect, a display apparatus includes: a display panel, wherein the display panel is divided into a plurality of pixel groups, each of the pixel groups includes a first pixel unit and a second pixel unit adjacent to each other, and each of the first and second pixel units comprises a first sub-pixel, a second sub-pixel and a third sub-pixel sequentially arranged in an order; and a driving module, configured to make each picture be displayed by using sequential multiple frames of images and obtain a first voltage signal and a second voltage signal of each of the pixel groups in each of the frames of images, and further configured to adjust the first voltage signal and the second voltage signal to make average signals of all the first voltage signals of the respective frames of images be the same, average signals of all the second voltage signals of the respective frames of images be the same, average signals of the first voltage signals in the multiple frames of images of different pixel groups respectively be the same, and average signals of the second voltage signals in the multiple frames of images of different pixel groups respectively be the same; wherein the first voltage signal is configured to drive the first sub-pixel and the third sub-pixel of the first pixel unit and the second sub-pixel of the second pixel unit, the second voltage signal is configured to drive the first sub-pixel and the third sub-pixel of the second pixel unit and the second sub-pixel of the first pixel unit, and the first voltage signal is not equal to the second voltage signal.

In an embodiment, in the display panel, for adjacent two pixel groups, the first pixel unit of one pixel group is disposed adjacent to the second pixel unit of the other one pixel group.

In an embodiment, the adjacent two pixel groups are two pixel groups adjacent to each other in a row direction or in a column direction.

The above driving method of a display panel and display apparatus use a high and low voltages pixel driving manner of multi-frame period, so that the average signals of all high voltage signals of the respective frames of images are the same, the average signals of all low voltage signals of the respective frames of images are the same, the average signals of high voltage signals in the multiple frames of images for different pixel groups respectively are the same, and the average signals of low voltage signals in the multiple frames of images for different pixel groups respectively are the same. Therefore, the respective timings exhibit the same luminance signal, and the problem of low frequency brightness flicker is solved consequently.

BRIEF DESCRIPTION OF THE DRAWINGS

FIG. 7 is a schematic diagram of voltage signals of sub-pixels according to another embodiment.

FIG. 8 is a schematic diagram of voltage signals of sub-pixels according to another embodiment.

FIG. 9 is a schematic diagram of voltage signals of sub-pixels according to another embodiment.

DETAILED DESCRIPTION OF EMBODIMENTS

In order to facilitate the understandings of the disclosure, the disclosure will be described below more fully with reference to accompanying drawings. Preferred embodiments of the disclosure are given in the accompanying drawings. However, the disclosure may be embodied in many different forms and is not limited to the embodiments described herein. Rather, the purposes of providing these embodiments are to make the understanding of the described content of the disclosure be more thorough and comprehensive.

Unless otherwise defined, all technical and scientific terms used herein have same meanings as commonly understood by one skilled in the art to which the disclosure pertains. The terms used herein in the specification of the disclosure are merely for the purpose of describing specific embodiments and are not intended to be limiting of the disclosure. The term "and/or" as used herein includes any and all combinations of one or more of the associated listed items.

Figure 1:
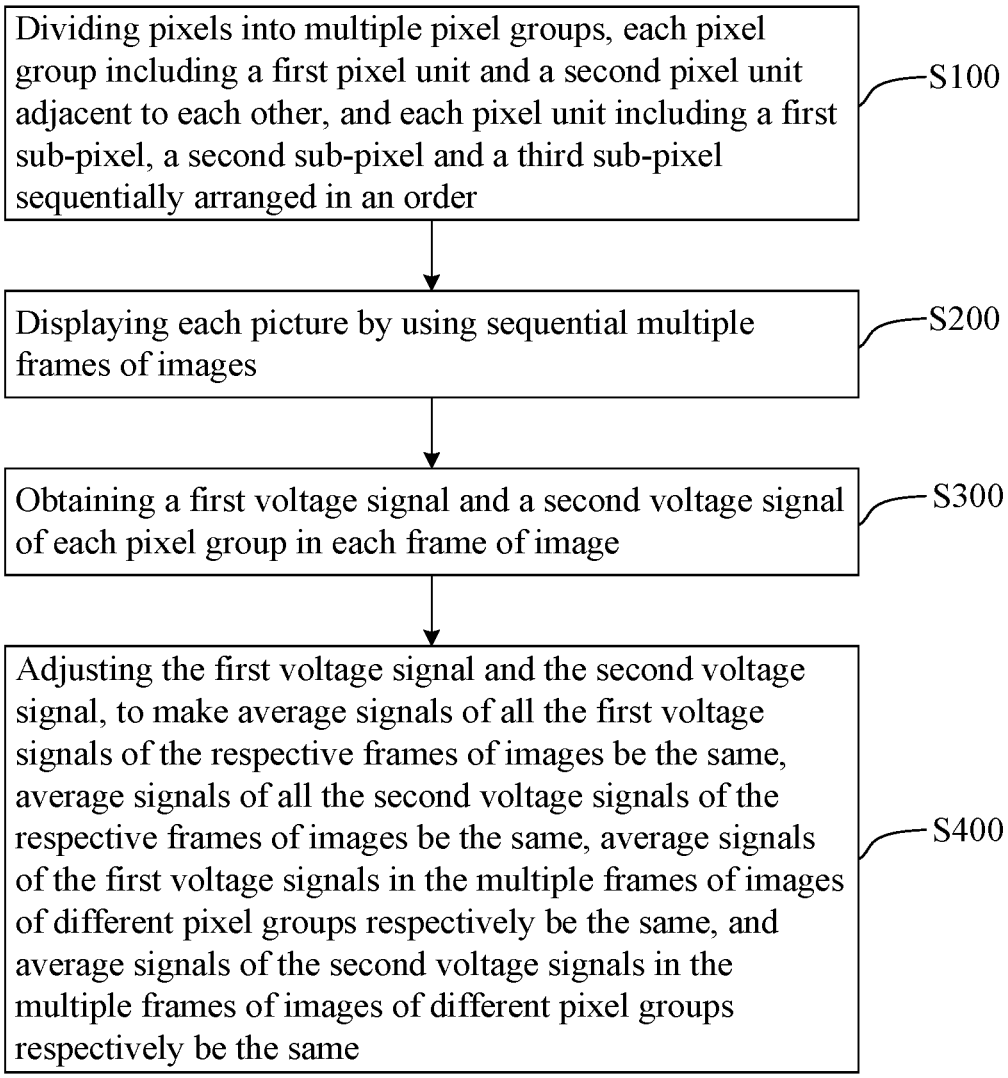
FIG. 1 is a flow chart of a driving method of a display panel according to an embodiment.

FIG. 1 is a flow chart of a driving method of a display panel according to an embodiment. The driving method includes the following content associated with steps.

Step S100: dividing pixels into multiple pixel groups, each pixel group including a first pixel unit and a second pixel unit adjacent to each other, and each pixel unit including a first sub-pixel, a second sub-pixel and a third sub-pixel sequentially arranged in an order.

In particular, each pixel unit includes three color sub-pixels respectively being a red sub-pixel, a green sub-pixel and a blue sub-pixel, and driving voltage polarities for adjacent sub-pixels are opposite.

Step S200: displaying each picture by using sequential multiple frames of images.

In particular, the multiple frames of images are four frames of images sequentially being a first frame of image, a second frame of image, a third frame of image and a fourth frame of image.

For example, a 6-bit driver IC is used to achieve an 8-bit display effect. Because the 6-bit driver IC only can display 64 levels of grayscales while the 8-bit display effect requires 256 levels of grayscales, and therefore a FRC (Frame Rate Control) technology may be used to make each picture be displayed by sequential four frames of images. Based on the visual inertia of the human eye, by suitably controlling a frame rate and grayscale signals of adjacent frames, a 6-bit panel may exhibit an 8-bit display effect.

Step S300: obtaining a first voltage signal and a second voltage signal of each pixel group in each frame of image. In particular, the first voltage signal is configured (i.e., structured and arranged) to drive the first sub-pixel and the third sub-pixel of the first pixel unit as well as the second sub-pixel of the second pixel unit, the second voltage signal is configured to drive the first sub-pixel and the third sub-pixel of the second pixel unit as well as the second sub-pixel of the first pixel unit, and the first voltage signal is not equal to the second voltage signal.

In an concrete embodiment, the first voltage signal is higher than the second voltage signal, that is, the first voltage signal is a high voltage signal and the second voltage signal is a low voltage signal.

Moreover, the first voltage signal and the second voltage signal are respectively corresponding to different signal values. For example, the signal values corresponding to the first voltage signal are 124 and 128, and the signal values corresponding to the second voltage signal are 56 and 60. Therefore, the sub-pixels driven by the first voltage signal and the second voltage signal may have different signal values correspondingly.

Step S400: adjusting the first voltage signal and the second voltage signal, to make average signals of all the first voltage signals of the respective frames of images be the same, average signals of all the second voltage signals of the respective frames of images be the same, average signals of the first voltage signals in the multiple frames of images of different pixel groups respectively be the same, and average signals of the second voltage signals in the multiple frames of images of different pixel groups respectively be the same.

In the driving method of a display panel provided by the above embodiment, by using a high and low voltage pixel driving manner of multi-frame period, an average signal of all the high voltage signals of each frame of image is the same as the average signal of all the high voltage signals of any one of the other frames of images, an average signal of all the low voltage signals of each frame of image is same as the average signal of all the low voltage signals of any one of the other frames of images, an average signal of the high voltage signals in the multiple frames of images of each of different pixel groups is the same as the average signal of the high voltage signals in the multiple frames of images of any one of the others of the different pixel groups, and an average signal of the low voltage signals in the multiple frames of images of each of different pixel groups is the same as the average signal of the low voltage signals in the multiple frames of images of any one of the others of the different pixel groups. As a result, the respective frame timings exhibit the same brightness signal, and the problem of low frequency flicker is solved consequently.

Figure 2:
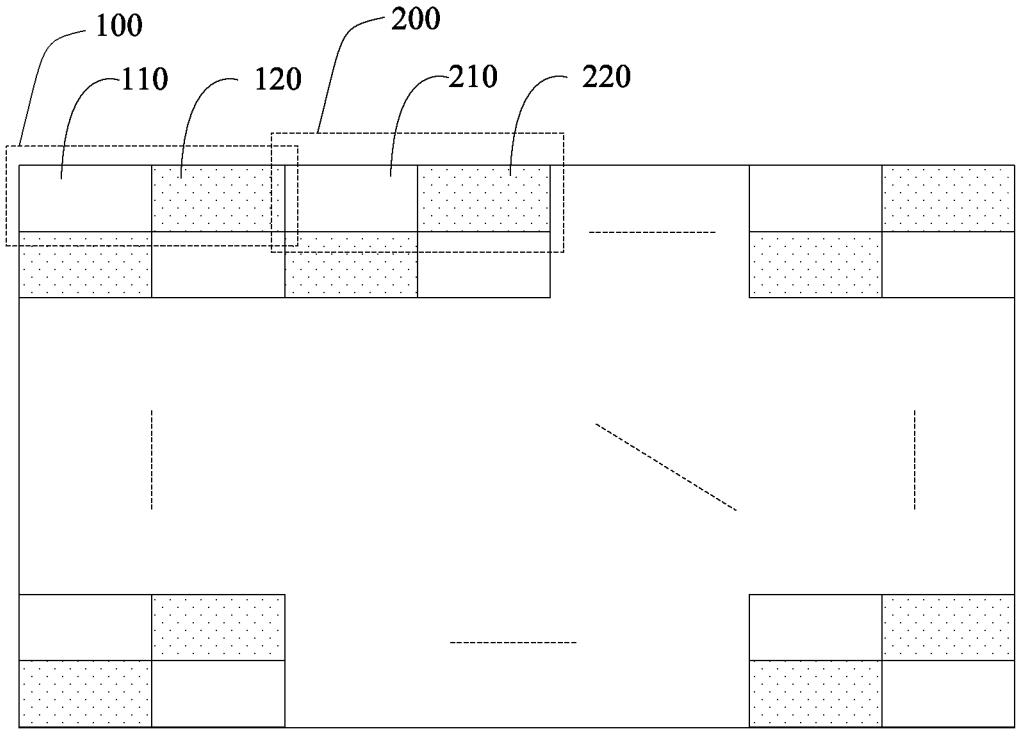
FIG. 2 is a schematic view of an arrangement of pixel groups according to an embodiment.

In an exemplary embodiment, as shown in FIG. 2, the first pixel unit 110 and the second pixel unit 120 associated with the step S100 are adjacently disposed in a same row.

Moreover, in the same row, for adjacent two pixel groups, the first pixel unit 210 in one pixel group 200 and the second pixel unit 120 in the other one pixel group 100 are disposed adjacent with each other.

Figure 3:
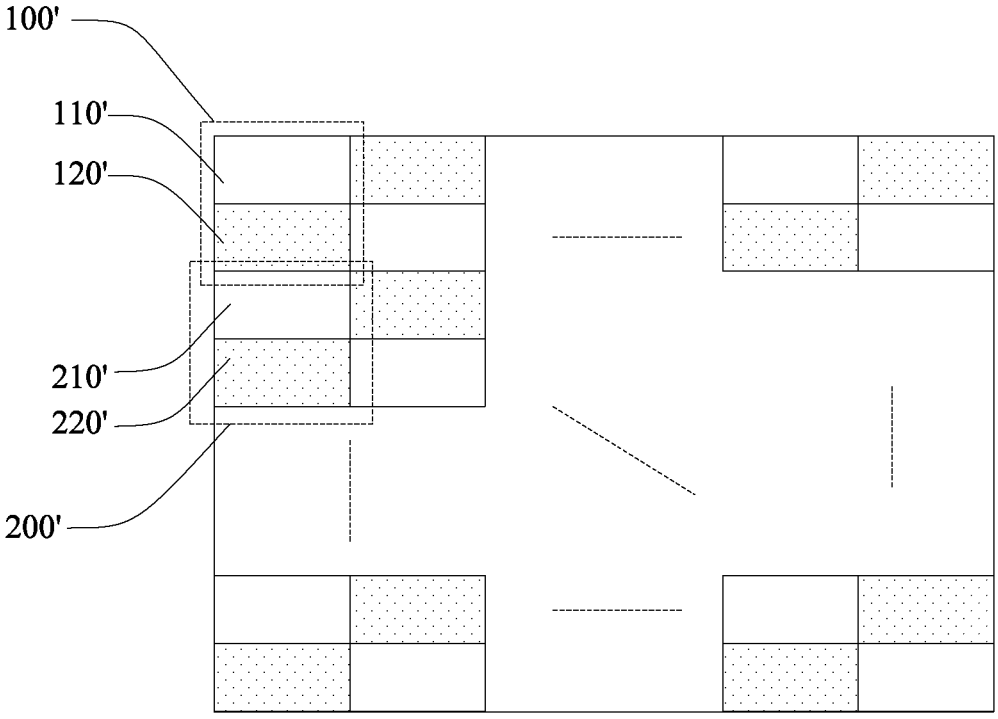
FIG. 3 is a schematic view of an arrangement of pixel groups according to another embodiment.

It should be understood that, an arrangement manner of the first pixel unit 110 and the second pixel unit 120 in the pixel group 100 is not limited to the above embodiment, and may be another arrangement manner as shown in FIG. 3 instead. That is, the first pixel unit 110' and the second pixel unit 120' are adjacently disposed in a same column.

Moreover, in the same column, as to adjacent two pixel groups, the first pixel unit 210' of one pixel group 200' and the second pixel unit 120' of the other one pixel group 100' are disposed adjacent to each other.

In the above embodiment, each pixel unit includes three color sub-pixels respectively being a red sub-pixel, a green sub-pixel and a blue sub-pixel, and driving voltage polarities for adjacent sub-pixels are opposite.

In a concrete embodiment, a 6-bit driver IC being used for achieving an 8-bit resolution is taken as an example. By controlling a frame rate and using four frames as a period to display one picture, the 6-bit driver IC can achieve high voltage signals of 124 and 128 as well as low voltage signals of 56 and 60. In order to achieve a combination of a high voltage signal of 125 and a low voltage signal of 57, spatial and temporal distributions of the high voltage signals of 124 and 128 are required to achieve the high voltage signal of 125, spatial and temporal distributions of the low voltage signals of 56 and 60 are required to achieve the low voltage signal of 57.

The frame rate control is a method of realizing a target grayscale display by a color mixing manner based on the visual inertia of human eyes. The color mixing manners may be classified into spatial color mixing and temporal color mixing, and in order to achieve better display effect, both of the two color mixing manner usually are used simultaneously.

Figures 4, 5, 6:
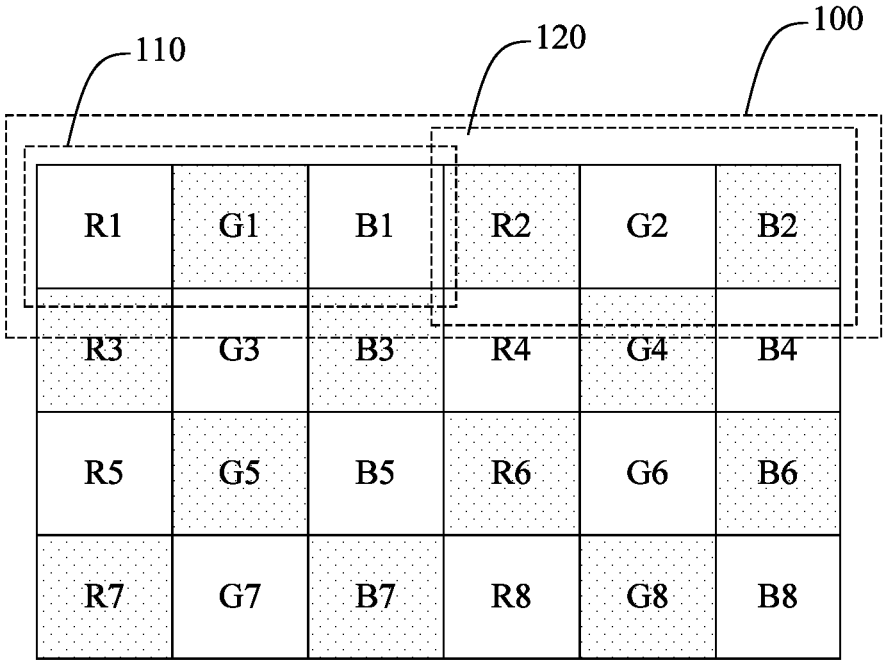
FIG. 4 is a schematic view of an arrangement of sub-pixels according to an embodiment.
FIG. 5 is a schematic diagram of voltage signals of sub-pixels according to another embodiment.
FIG. 6 is a schematic diagram of voltage signals of sub-pixels according to another embodiment.

In an exemplary embodiment, as shown in FIG. 4, an implementation manner of the step 100 includes the following content. In particular, for each frame of display image, four pixel groups are used as one display unit, the four pixel groups are longitudinally arranged (i.e., arranged along a longitudinal direction), each pixel group includes a first pixel unit and a second pixel unit, the first pixel units and the second pixel units in adjacent pixel groups are alternately arranged (i.e., in the adjacent pixel groups, the first pixel unit of one pixel group is adjacent to the second pixel unit of the other one pixel group). Each pixel unit includes a red sub-pixel (R), a green sub-pixel (G) and a blue sub-pixel (B) sequentially arranged in an order; the red sub-pixel (R) and the blue sub-pixel (B) of the first pixel unit as well as the green sub-pixel (G) of the second pixel unit use a first voltage signal (high voltage signal) to be driven, the green sub-pixel (G) of the first pixel unit as well as the red sub-pixel (R) and the blue sub-pixel (B) of the second pixel unit use a second voltage signal (low voltage signal) to be driven. For example, the first pixel group 100 includes the first pixel unit 110 and the second pixel unit 120, the first pixel unit 110 includes the red sub-pixel (R1), the green sub-pixel (G1) and the blue sub-pixel (B1) sequentially arranged in an order, the second pixel unit 120 includes the red sub-pixel (R2), the green sub-pixel (G2) and the blue sub-pixel (B2) sequentially arranged in an order. The red sub-pixel (R1) and the blue sub-pixel (B1) of the first pixel unit 110 as well as the green sub-pixel (G2) of the second pixel unit 120 use the first voltage signal (high voltage signal) to be driven, the green sub-pixel (G1) of the first pixel unit 110 as well as the red sub-pixel (R2) and the blue sub-pixel (B2) of the second pixel unit 120 use the second voltage signal (low voltage signal) to be driven. Other three pixel groups are similar to the first pixel group 100, and thus will be not repeated herein. Therefore, the high voltage signal and the low voltage signal in the figure alternately drive the sub-pixels.

In an exemplary embodiment, the multiple frames of images in the step S200 is four frames of images.

In an exemplary embodiment, as shown in FIG. 5, an implementation manner of the step S300 includes the following content. In particular, four frames are taken as one display period. In the figure, A1-128 represents a voltage signal of a sub-pixel A1 is 128, and A2-56 represents a voltage signal of a sub-pixel A2 is 56. That is, the sub-pixel A1 is the red sub-pixel (R1) or the blue sub-pixel (B1) of the first pixel unit 110 in FIG. 4 and uses the first voltage signal (high voltage signal) to be driven; and the sub-pixel A2 is the red sub-pixel (R2) or the blue sub-pixel (B2) of the second pixel unit 120 and uses the second voltage signal (low voltage signal) to be driven. It should be understood that, the sub-pixel A1 and the sub-pixel A2 satisfy a condition of having the same color. According to the above naming rule, it can be found that A1, A2, A3, A4, A5, A6, A7 and A8 are sub-pixels with the same color (red sub-pixels or blue sub-pixels), and the sub-pixels A1 and A2, the sub-pixels A3 and A4, the sub-pixels A5 and A6, and the sub-pixels A7 and A8 belong to different pixel groups. It should be understood that the sub-pixels A1, A4, A5 and A8 respectively are the first sub-pixels or the third sub-pixels in the first pixel units of different pixel groups and use the first voltage signals (high voltage signals) to be driven. The sub-pixels A2, A3, A6 and A7 respectively are the first sub-pixels or the third sub-pixels in the second pixel units of different pixel groups and use the second voltage signals (low voltage signals) to be driven.

In an exemplary embodiment, an implementation manner of the step S400 includes the following content. In particular, as seen from FIG. 5, in a first frame, the first voltage signals for the sub-pixels A1, A4, A5 and A8 respectively are 128, 124, 124 and 124; the second voltage signals for the sub-pixels A2, A3, A6 and A7 respectively are 56, 56, 60 and 56. In a second frame, the first voltage signals for the sub-pixels A1, A4, A5 and A8 respectively are 124, 124, 128 and 124; and the second voltage signals for the sub-pixels A2, A3, A6 and A7 respectively are 60, 56, 56 and 56. In a third frame, the first voltage signals for the sub-pixels A1, A4, A5 and A8 respectively are 124, 128, 124 and 124; and the second voltage signals for the sub-pixels A2, A3, A6 and A7 respectively are 56, 56, 56 and 60. In a fourth frame, the first voltage signals for the sub-pixels A1, A4, A5 and A8 respectively are 124, 124, 124 and 128; and the second voltage signals for the sub-pixels A2, A3, A6 and A7 respectively are 56, 60, 56 and 56.

In one aspect, in the first frame, an average signal of the first voltage signals for the sub-pixels A1, A4, A5 and A8 is:

$$\frac{128+124+124+124}{4}=125.$$

Moreover, in each of the second frame, the third frame and the fourth frame, the average signal of the first voltage signals for the sub-pixels A1, A4, A5 and A8 also is 125 and thus is equal to the average signal of the first voltage signals for the sub-pixels A1, A4, A5 and A8 in the first frame.

In another aspect, in the first frame, an average signal of the second voltage signals for the sub-pixels A2, A3, A6 and A7 is:

$$\frac{56+56+60+56}{4}=57.$$

Moreover, in each of the second frame, the third frame and the fourth frame, the average signal of the second voltage signals for the sub-pixels A2, A3, A6 and A7 also is 57 and thus is equal to the average signal of the second voltage signals for the sub-pixels A2, A3, A6 and A7 in the first frame.

Therefore, in spatial aspect (i.e., in each frame), the average signal of the first voltage signals (high voltage signals) for all sub-pixels is 125, and the average signal of the second voltage signals (low voltage signals) for all sub-pixels is 57. In particular, as listed in the following table 1.

TABLE 1

| Voltage signal | Frame No. First frame | Second frame | Third frame | Fourth frame |
|---|---|---|---|---|
| Average signal of first voltage signals | 125 | 125 | 125 | 125 |
| Average signal of second voltage signals | 57 | 57 | 57 | 57 |

In addition, as shown in FIG. 4, in one hand, an average signal of the first voltage signals in the four frames for the sub-pixel A1 is:

$$\frac{128+124+124+124}{4}=125.$$

Likewise, the average signal of the first voltage signals in the four frames for each of the sub-pixels A4, A5 and A8 also is 125 and thus is the same as the average signal of the first voltage signals in the four frames for the sub-pixel A1.

In other hand, an average signal of the second voltage signals in the four frames for the sub-pixel A2 is that:

$$\frac{56+60+56+56}{4}=57.$$

Likewise, the average signal of the second voltage signals in the four frames for each of the sub-pixels A3, A6 and A7 also is 57 and thus is the same as the average signal of the second voltage signals in the four frames for the sub-pixel A2.

Therefore, in temporal aspect (i.e., in the four frames), the average signal of the first voltage signals for each of the sub-pixels A1, A4, A5 and A8 (high voltage signal pixel units) is 125; and the average signal of the second voltage signals for each of the sub-pixels A2, A3, A6 and A7 (low voltage signal pixel units) is 57. In particular, as listed in the following table 2.

TABLE 2

| Sub-pixel | First frame | Second frame | Third frame | Fourth frame | Average signal |
|---|---|---|---|---|---|
| A1 | 128 | 124 | 124 | 124 | 125 |
| A2 | 56 | 60 | 56 | 56 | 57 |
| A3 | 56 | 56 | 56 | 60 | 57 |
| A4 | 124 | 124 | 128 | 124 | 125 |
| A5 | 124 | 128 | 124 | 124 | 125 |
| A6 | 60 | 56 | 56 | 56 | 57 |
| A7 | 56 | 56 | 60 | 56 | 57 |
| A8 | 124 | 124 | 124 | 128 | 125 |

In addition, as shown in FIG. 6, in the figure, G1-56 represents a voltage signal for the sub-pixel G1 is 56, G2-128 represents a voltage signal for the sub-pixel G2 is 128. That is, the sub-pixel G1 represents the green sub-pixel (G1) of the first pixel unit 110 in FIG. 4 and uses the second voltage signal (low voltage signal) to be driven, and the sub-pixel G2 represents the green sub-pixel (G2) of the second pixel unit 120 in FIG. 4 and uses the first voltage signal (high voltage signal) to be driven. According to the above naming rule, it can be found that the sup-pixels G1, G2, G3, G4, G5, G6, G7 and G8 have the same color and all are green sub-pixels. Furthermore, the sub-pixels G1, G4, G5 and G8 respectively belong to the first pixel units 110 of different pixel groups and use the second voltage signals (low voltage signals) to be driven; and the sub-pixels G2, G3, G6 and G7 respectively belong to the second pixel units 120 of different pixel groups and use the first voltage signals (high voltage signals) to be driven.

According to the description associated with FIG. 5, it can be rightly found that for the green sub-pixels (G1, G2, G3, G4, G5, G6, G7 and G8) in FIG. 6, an average signal of the first voltage signals (high voltage signals) in spatial aspect (i.e., each frame) is 125, and an average signal of the second voltage signals (low voltage signals) in spatial aspect is 57; and in temporal aspect (i.e., for four frames), an average signal of the first voltage signals is 125, and an average signal of the second voltage signals is 57.

In the above embodiments, by adjusting distributions of high voltage signals and low voltage signals in spatial and temporal aspects, it can realize equivalent high voltage signals (average signals) in spatial and temporal being 125 and equivalent low voltage signals (average signals) in spatial and temporal being 57 for red sub-pixels (R), blue sub-pixels (B) and green sub-pixels (G) in the picture, and thus can ensure that the low frequency brightness flicker is not easily perceived.

It should be understood that, by adjusting distributions of first voltage signals and second voltage signals in spatial and temporal aspects, it also can achieve a picture display effect of high voltage signal being 126 and low voltage signal being 58, and a picture display effect of high voltage signal being 127 and low voltage signal being 59, please refer to FIG. 7 and FIG. 8 for details.

Figures 10, 11:
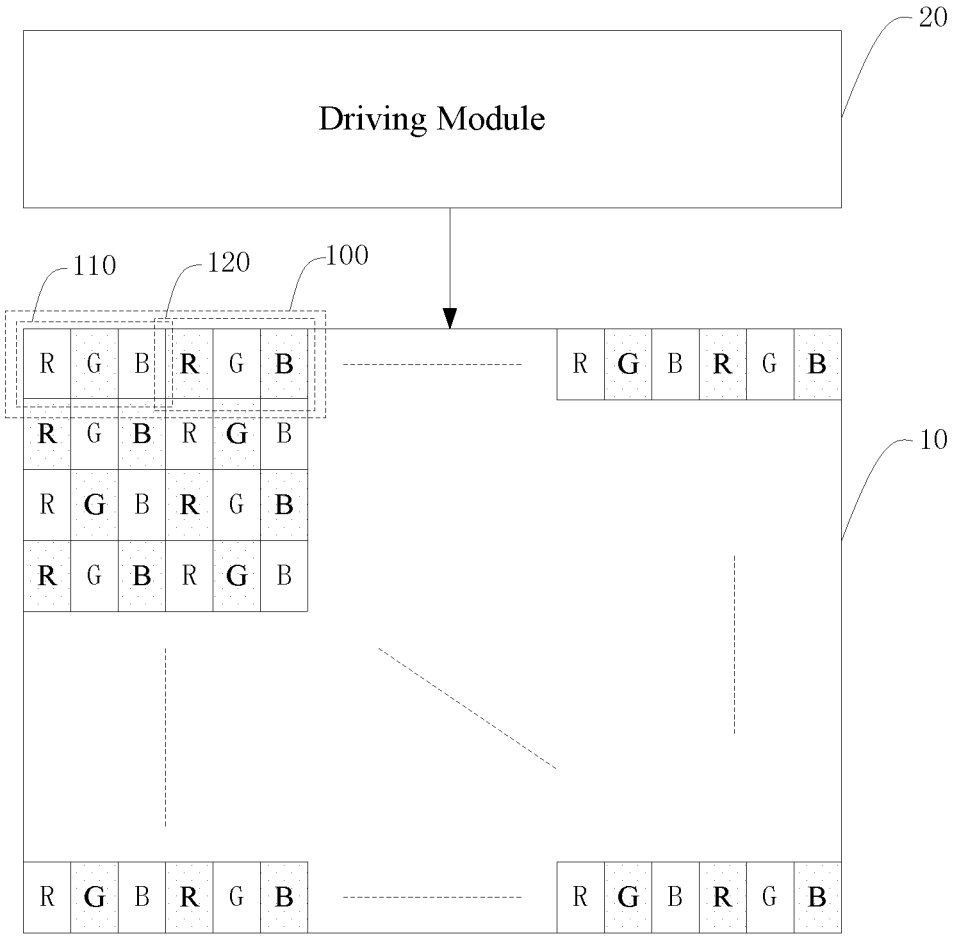
FIG. 10 is a schematic diagram of voltage signals of sub-pixels according to another embodiment.
FIG. 11 is a schematic view of a display apparatus according to an embodiment.

In addition, when the first voltage signal and the second voltage signal are kept unchanged in spatial and temporal (i.e., in each frame of image and in the multiple frames of images, the first voltage signal and the second voltage signal are kept unchanged), it can achieve display effects such as a combination of high voltage signal being 124 and low voltage signal being 56, or a combination of high voltage signal being 128 and low voltage signal being 60, please refer to FIG. 9 and FIG. 10 for details.

In addition, an embodiment of the disclosure provides a display apparatus. As shown in FIG. 11, the display apparatus includes:

a display panel 10, wherein the display panel is divided into multiple pixel groups 100, each pixel group 100 includes a first pixel unit 110 and a second pixel unit 120 adjacent to each other, and each pixel unit includes a first sub-pixel R, a second sub-pixel G and a third sub-pixel B arranged in sequence;

a driving module (also referred to as driving circuit) 20, configured to make each picture be displayed by sequential multiple frames of images and obtain a first voltage signal and a second voltage signal for each pixel group 100 in each frame of image; and further configured to adjust the first voltage signal and the second voltage signal, to make average signals of all the first voltage signals for the respective frames of images be the same, average signals of all the second voltage signals for the respective frames of images be the same, average signals of the first voltage signals in the multiple frames of images for different pixel groups respectively be the same, and average signals of the second voltage signals in the multiple frames of images for different pixel groups respectively be the same. Wherein the first voltage signal drives the first sub-pixel R and the third sub-pixel B of the first pixel unit 110 as well as the second sub-pixel G of the second pixel unit 120, the second voltage signal drives the first sub-pixel R and the third sub-pixel B of the second pixel unit 120 as well as the second sub-pixel G of the first pixel unit 110, and the first voltage signal is not equal to the second voltage signal.

In an exemplary embodiment, in the above display panel 10, for adjacent two pixel groups, the first pixel unit of one pixel group and the second pixel unit of the other one pixel group are adjacently disposed.

In an embodiment, the adjacent two pixel groups are two pixel groups adjacent to each other in a row direction or in a column direction.

Figure 12:
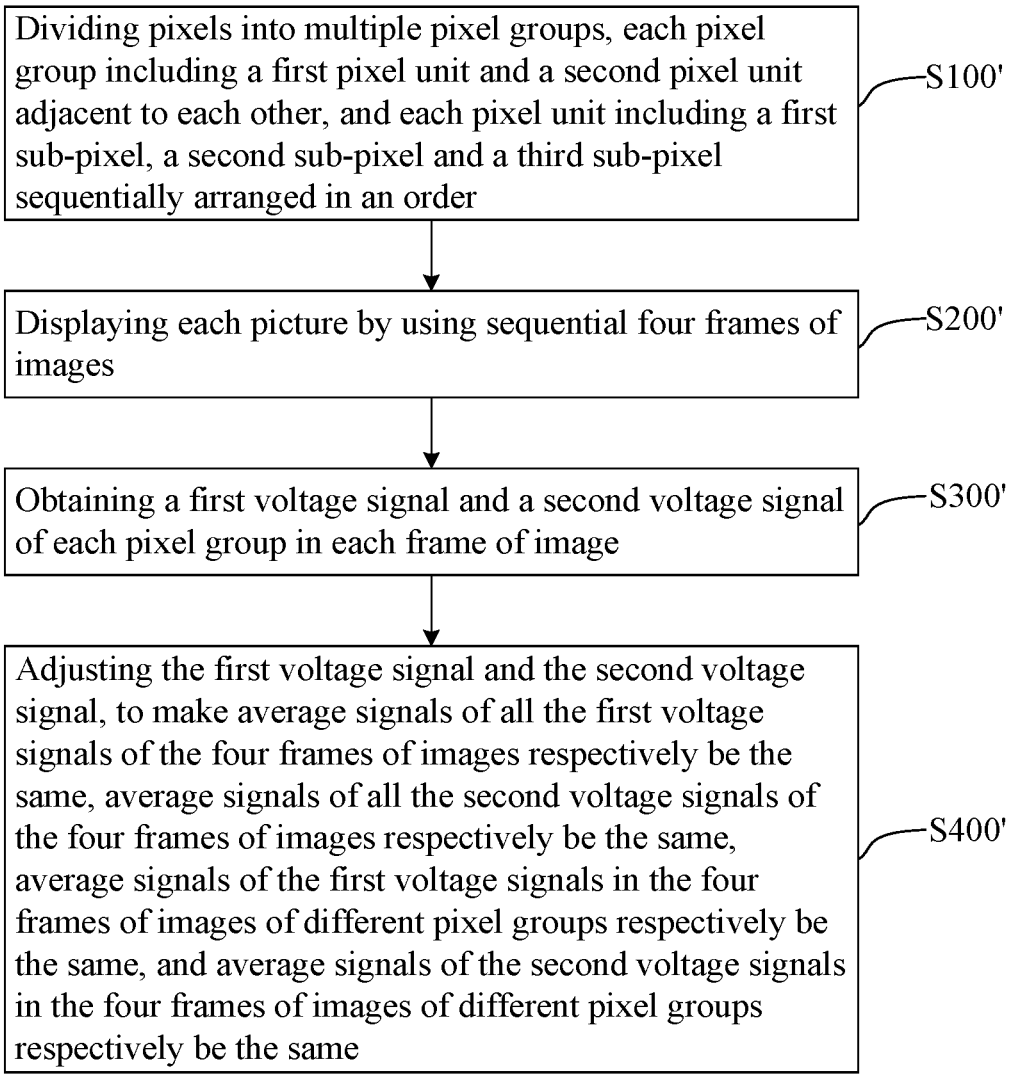
FIG. 12 is a flow chart of a driving method of a display panel according to another embodiment.

In an exemplary embodiment, as shown in FIG. 12, the figure is a flow chart of a driving method of a display panel. When a display period of one picture is a four-frame period, and the first voltage signal is higher than the second voltage signal, steps of the method includes the following content.

Step S100': dividing pixels into multiple pixel groups, each pixel group including a first pixel unit and a second pixel unit adjacent to each other, and each pixel unit including a first sub-pixel, a second sub-pixel and a third sub-pixel sequentially arranged in an order.

Step S200': displaying each picture by sequential four frames of images.

Step S300': obtaining a first voltage signal and a second voltage signal of each pixel group in each frame of image, wherein the first voltage signal drives the first pixel unit, the second voltage signal drives the second pixel unit, and the first voltage signal is higher than the second voltage signal.

Step S400': adjusting the first voltage signal and the second voltage signal and thereby making average signals of all the first voltage signals of the four frames of images respectively be the same, average signals of all the second voltage signals of the four frames of images respectively be the same, average signals of the first voltage signals in the four frames of images for different pixel groups respectively be the same, and average signals of the second voltage signals in the four frames of images for different pixel groups respectively be the same.

In an embodiment, the first voltage is a higher voltage signal with respect to the second voltage signal, and correspondingly the second voltage signal is a low voltage signal. In addition, the first voltage signal and the second voltage signal respectively have different voltage signal values, and these voltage signal values represent luminance signals displayed by sub-pixels. The above embodiment adjusts luminance signals of the sub-pixels in each frame as well as four-frame period, so that average luminance signals in each frame (in spatial) as well as four-frame period (in temporal) of luminance signals of respective sub-pixels are correspondingly consistent.

The above display apparatus uses a high and low voltages pixel driving manner of multi-frame period, so that the average signals of all the high voltage signals of the respective frames of images are the same, the average signals of all the low voltage signals of the respective frames of images are the same, the average signals of the high voltage signals in the multiple frames of images for different pixel groups respectively are the same, and the average signals of the low voltage signals in the multiple frames of images for different pixel groups respectively are the same. Therefore, the respective timings exhibit the same luminance signal, and the problem of low frequency brightness flicker is solved consequently.

The technical features of the above mentioned embodiments can be combined arbitrarily, and for the sake of brevity, not all possible combinations of the technical features in the above embodiments are described, however, as long as there is no conflict in a combination of these technical features, it should be considered as the scope of the description.

The above mentioned embodiments merely present several embodiments of the disclosure, which are described in more specific and in detail, but should not be interpreted as limiting the scope of the disclosure. It should be noted that one skilled in the art may make various modifications and improvements without departing from the concept of the disclosure, all of which should be included in the protection scope of the disclosure. Therefore, the protection scope of the patent application shall be subjected to the appended claims.

What is claimed is:

1. A driving method of a display panel using a n-bit driver IC to realize a m-bit picture quality resolution, where m, n both are positive integers, and m is greater than n, the driving method comprising:

dividing pixels into a plurality of pixel groups, wherein each of the pixel groups comprises a first pixel unit and a second pixel unit adjacent to each other, each of the first and second pixel units comprises a first sub-pixel, a second sub-pixel and a third sub-pixels sequentially arranged in an order;

displaying each picture by using sequential multiple frames of images;

obtaining a first voltage signal and a second voltage signal of each of the pixel groups in each of the frames of images, wherein the first voltage signal drives the first sub-pixel and the third sub-pixel of the first pixel unit and the second sub-pixel of the second pixel unit, the second voltage signal drives the first sub-pixel and the third sub-pixel of the second pixel unit and the second sub-pixel of the first pixel unit, and the first voltage signal is not equal to the second voltage signal;

adjusting the first voltage signal and the second voltage signal to make average signals of all the first voltage signals of the respective frames of images be the same, average signals of all the second voltage signals of the respective frames of images be the same, average signals of the first voltage signals in the multiple frames of images of different ones of the pixel groups respectively be the same, and average signals of the second voltage signals in the multiple frames of images of different ones of the pixel groups respectively be the same;

wherein the first pixel unit and the second pixel unit are adjacently disposed in a same row;

wherein in the same row, for adjacent two of the pixel groups, the first pixel unit of one pixel group is disposed adjacent to the second pixel unit of the other one pixel group;

wherein the first voltage signal is higher than the second voltage signal;

wherein more than one of the plurality of pixel groups are arranged along a longitudinal direction as one display unit, all the first pixel units in the display unit are arranged in a zigzag manner in the longitudinal direction, and all the second pixel units in the display unit are arranged in a zigzag manner in the longitudinal direction;

wherein the first voltage signals for the first sub-pixels of all the first pixel units of the display unit in each of the sequential multiple frames of images are not completely the same when an average signal of the first voltage signals for the first sub-pixels of all the first pixel units of the display unit is not a positive integer times of $2^{(m-n)}$, and the first voltage signals for the first sub-pixel of the same one of all the first pixel units of the display unit in the sequential multiple frames of images are not completely the same when an average signal of the first voltage signals for the first sub-pixel of the same one of all the first pixel units of the display unit in the sequential multiple frames of images is not a positive integer times of $2^{(m-n)}$;

wherein the second voltage signals for the first sub-pixels of all the second pixel units of the display unit in each of the sequential multiple frames of images are not completely the same when an average signal of the second voltage signals for the first sub-pixels of all the second pixel units of the display unit is not a positive integer times of $2^{(m-n)}$, and the second voltage signals for the first sub-pixel of the same one of all the second pixel units of the display unit in the sequential multiple frames of images are not completely the same when an average signal of the second voltage signals for the first sub-pixel of the same one of all the second pixel units of the display unit in the sequential multiple frames of images is not a positive integer times of $2^{(m-n)}$;

wherein the second voltage signals for the second sub-pixels of all the first pixel units of the display unit in each of the sequential multiple frames of images are not completely the same when an average signal of the second voltage signals for the second sub-pixels of all the first pixel units of the display unit is not a positive integer times of $2^{(m-n)}$, and the second voltage signals for the second sub-pixel of the same one of all the first pixel units of the display unit in the sequential multiple frames of images are not completely the same when an average signal of the second voltage signals for the second sub-pixel of the same one of all the first pixel units of the display unit in the sequential multiple frames of images is not a positive integer times of $2^{(m-n)}$;

wherein the first voltage signals for the second sub-pixels of all the second pixel units of the display unit in each of the sequential multiple frames of images are not completely the same when an average signal of the first voltage signals for the second sub-pixels of all the second pixel units of the display unit is not a positive integer times of $2^{(m-n)}$, and the first voltage signals for the second sub-pixel of the same one of all the second pixel units of the display unit in the sequential multiple frames of images are not completely the same when an average signal of the first voltage signals for the second sub-pixel of the same one of all the second pixel units of the display unit in the sequential multiple frames of images is not a positive integer times of $2^{(m-n)}$.

2. A driving method of a display panel using a n-bit driver IC to realize a m-bit picture quality resolution, where m, n both are positive integers, and m is greater than n, the driving method, comprising:

dividing pixels into a plurality of pixel groups, wherein each of the pixel groups comprises a first pixel unit and a second pixel unit adjacent to each other, each of the first and second pixel units comprises a first sub-pixel, a second sub-pixel and a third sub-pixels sequentially arranged in an order;

displaying each picture by using sequential multiple frames of images;

obtaining a first voltage signal and a second voltage signal of each of the pixel groups in each of the frames of images, wherein the first voltage signal drives the first sub-pixel and the third sub-pixel of the first pixel unit and the second sub-pixel of the second pixel unit, the second voltage signal drives the first sub-pixel and the third sub-pixel of the second pixel unit and the second sub-pixel of the first pixel unit, and the first voltage signal is not equal to the second voltage signal;

adjusting the first voltage signal and the second voltage signal to make average signals of all the first voltage signals of the respective frames of images be the same, average signals of all the second voltage signals of the respective frames of images be the same, average signals of the first voltage signals in the multiple frames of images of different pixel groups respectively be the same, and average signals of the second voltage signals in the multiple frames of images of different pixel groups respectively be the same;

wherein more than one of the plurality of pixel groups are arranged along a longitudinal direction as one display unit, all the first pixel units in the display unit are arranged in a zigzag manner in the longitudinal direction, and all the second pixel units in the display unit are arranged in a zigzag manner in the longitudinal direction;

wherein the first voltage signals for the first sub-pixels of all the first pixel units of the display unit in each of the sequential multiple frames of images are not completely the same when an average signal of the first voltage signals for the first sub-pixels of all the first pixel units of the display unit is not a positive integer times of $2^{(m-n)}$, and the first voltage signals for the first sub-pixel of the same one of all the first pixel units of the display unit in the sequential multiple frames of images are not completely the same when an average signal of the first voltage signals for the first sub-pixel of the same one of all the first pixel units of the display unit in the sequential multiple frames of images is not a positive integer times of $2^{(m-n)}$;

wherein the second voltage signals for the first sub-pixels of all the second pixel units of the display unit in each of the sequential multiple frames of images are not completely the same when an average signal of the second voltage signals for the first sub-pixels of all the second pixel units of the display unit is not a positive integer times of $2^{(m-n)}$, and the second voltage signals for the first sub-pixel of the same one of all the second pixel units of the display unit in the sequential multiple frames of images are not completely the same when an average signal of the second voltage signals for the first sub-pixel of the same one of all the second pixel units of the display unit in the sequential multiple frames of images is not a positive integer times of $2^{(m-n)}$;

wherein the second voltage signals for the second sub-pixels of all the first pixel units of the display unit in each of the sequential multiple frames of images are not completely the same when an average signal of the second voltage signals for the second sub-pixels of all the first pixel units of the display unit is not a positive integer times of $2^{(m-n)}$, and the second voltage signals for the second sub-pixel of the same one of all the first pixel units of the display unit in the sequential multiple frames of images are not completely the same when an average signal of the second voltage signals for the second sub-pixel of the same one of all the first pixel units of the display unit in the sequential multiple frames of images is not a positive integer times of $2^{(m-n)}$;

wherein the first voltage signals for the second sub-pixels of all the second pixel units of the display unit in each of the sequential multiple frames of images are not completely the same when an average signal of the first voltage signals for the second sub-pixels of all the second pixel units of the display unit is not a positive integer times of $2^{(m-n)}$, and the first voltage signals for the second sub-pixel of the same one of all the second pixel units of the display unit in the sequential multiple frames of images are not completely the same when an average signal of the first voltage signals for the second sub-pixel of the same one of all the second pixel units of the display unit in the sequential multiple frames of images is not a positive integer times of $2^{(m-n)}$.

3. The driving method of a display panel according to claim 2, wherein the first pixel unit and the second pixel unit are adjacently disposed in a same row.

4. The driving method of a display panel according to claim 3, wherein in the same row, in the same row, for adjacent two of the pixel groups, the first pixel unit of one pixel group is disposed adjacent to the second pixel unit of the other one pixel group.

5. The driving method of a display panel according to claim 2, wherein the first pixel unit and the second pixel unit are adjacently disposed in a same column.

6. The driving method of a display panel according to claim 5, wherein in the same column, in the same row, for adjacent two of the pixel groups, the first pixel unit of one pixel group is disposed adjacent to the second pixel unit of the other one pixel group.

7. The driving method of a display panel according to claim 2, wherein the multiple frames of images are four frames of images, n is equal to 6, and m is equal to 8.

8. The driving method of a display panel according to claim 7, wherein the four frames of images sequentially are a first frame of image, a second frame of image, a third frame of image and a fourth frame of image.

9. The driving method of a display panel according to claim 2, wherein the first voltage signal is higher than the second voltage signal.

10. The driving method of a display panel according to claim 2, wherein each of the first and second pixel units comprises three color sub-pixels.

11. The driving method of a display panel according to claim 10, wherein the three color sub-pixels respectively are a red sub-pixel, a green sub-pixel and a blue sub-pixel.

12. The driving method of a display panel according to claim 2, wherein the first sub-pixel, the second sub-pixel and the third sub-pixel respectively are a red sub-pixel, a green sub-pixel and a blue sub-pixel.

13. The driving method of a display panel according to claim 2, wherein driving voltage polarities for adjacent sub-pixels are opposite.

14. The driving method of a display panel according to claim 2, wherein the first voltage signal and the second voltage signal respectively are corresponding to different signal values.

15. The driving method of a display panel according to claim 14, wherein the signal values corresponding to the first voltage signal are 124 and 128, and the signal values corresponding to the second voltage signal are 56 and 60.

16. The driving method of a display panel according to claim 15, wherein the sub-pixels driven by the first voltage signal and the second voltage signal have different signal values.

17. The driving method of a display panel according to claim 9, wherein the first voltage signal and the second voltage signal alternately drive the sub-pixels.

18. A display apparatus comprising:

a display panel using a n-bit driver IC to realize a m-bit picture quality resolution, wherein the display panel is divided into a plurality of pixel groups, each of the pixel groups comprises a first pixel unit and a second pixel unit adjacent to each other, and each of the first and second pixel units comprises a first sub-pixel, a second sub-pixel and a third sub-pixel sequentially arranged in an order, m, n both are positive integers, and m is greater than n;

a driving module, configured to make each picture be displayed by using sequential multiple frames of images and obtain a first voltage signal and a second voltage signal of each of the pixel groups in each of the frames of images, and further configured to adjust the first voltage signal and the second voltage signal to make average signals of all the first voltage signals of the respective frames of images be the same, average signals of all the second voltage signals of the respective frames of images be the same, average signals of the first voltage signals in the multiple frames of images of different pixel groups respectively be the same, and average signals of the second voltage signals in the multiple frames of images of different pixel groups respectively be the same; wherein the first voltage signal is configured to drive the first sub-pixel and the third sub-pixel of the first pixel unit and the second sub-pixel of the second pixel unit, the second voltage signal is configured to drive the first sub-pixel and the third sub-pixel of the second pixel unit and the second sub-pixel of the first pixel unit, and the first voltage signal is not equal to the second voltage signal;

wherein more than one of the plurality of pixel groups are arranged along a longitudinal direction as one display unit, all the first pixel units in the display unit are arranged in a zigzag manner in the longitudinal direction, and all the second pixel units in the display unit are arranged in a zigzag manner in the longitudinal direction;

wherein the first voltage signals for the first sub-pixels of all the first pixel units of the display unit in each of the sequential multiple frames of images are not completely the same when an average signal of the first voltage signals for the first sub-pixels of all the first pixel units of the display unit is not a positive integer times of $2^{(m-n)}$, and the first voltage signals for the first sub-pixel of the same one of all the first pixel units of the display unit in the sequential multiple frames of images are not completely the same when an average signal of the first voltage signals for the first sub-pixel of the same one of all the first pixel units of the display unit in the sequential multiple frames of images is not a positive integer times of $2^{(m-n)}$;

wherein the first voltage signals for the second sub-pixels of all the second pixel units of the display unit in each of the sequential multiple frames of images are not completely the same when an average signal of the first voltage signals for the second sub-pixels of all the second pixel units of the display unit is not a positive integer times of $2^{(m-n)}$, and the first voltage signals for the second sub-pixel of the same one of all the second pixel units of the display unit in the sequential multiple frames of images are not completely the same when an average signal of the first voltage signals for the second sub-pixel of the same one of all the second pixel units of the display unit in the sequential multiple frames of images is not a positive integer times of $2^{(m-n)}$.

19. The display apparatus according to claim 18, wherein in the display panel, for adjacent two pixel groups, the first pixel unit of one pixel group is disposed adjacent to the second pixel unit of the other one pixel group, n is equal to 6, and m is equal to 8.

20. The display apparatus according to claim 19, wherein the adjacent two pixel groups are two pixel groups adjacent to each other in a row direction or in a column direction.

* * * * *